US005337463A

United States Patent [19]

Rössler et al.

[11] Patent Number: 5,337,463

[45] Date of Patent: Aug. 16, 1994

[54] RIVET SETTING TOOL

[75] Inventors: Andreas Rössler, Fernwald; Hans-Dieter Waltenberg; Norbert Tessarsch, both of Giessen-Klein-Linden, all of Fed. Rep. of Germany

[73] Assignee: Emhart Inc., Newark, Del.

[21] Appl. No.: 112,831

[22] Filed: Aug. 26, 1993

[30] Foreign Application Priority Data

Aug. 29, 1992 [GB] United Kingdom ..... 9218463.9

[51] Int. Cl.[5] ..... B21J 15/34

[52] U.S. Cl. ..... 29/243.521; 29/243.53

[58] Field of Search ..... 227/51; 29/243.521, 29/243.522, 243.523, 243.524, 243.528, 243.53; 72/391.6

[56] References Cited

U.S. PATENT DOCUMENTS

| | | | |
|---|---|---|---|
| 3,002,644 | 10/1961 | Meyer | 29/243.523 |
| 4,059,980 | 11/1977 | Nance | 29/243.521 |
| 4,528,837 | 7/1985 | Jones et al. | 29/243.521 |
| 4,648,259 | 3/1987 | Pendleton | 29/243.521 |
| 4,765,175 | 8/1988 | Denham et al. | 29/243.53 |
| 5,170,923 | 12/1992 | Dear et al. | 29/243.522 |

FOREIGN PATENT DOCUMENTS

| | | | |
|---|---|---|---|
| 1572269 | 7/1980 | United Kingdom | 29/243.521 |

*Primary Examiner*—Scott Smith
*Attorney, Agent, or Firm*—Edward D. Murphy

[57] ABSTRACT

A rivet setting tool for use with double headed blind rivets comprises a collet assembly adapted to engage a pulling head of the rivet, and abutment members movable between an open position, in which the pulling head of the mandrel of the rivet may be passed through the abutment assembly to be engaged by the collet assembly, and a closed position in which the abutment members provide an abutment to engage the rivet head. The abutment members are mounted for generally axial movement and when a double headed blind rivet is presented axially to the tool, the head of the rivet engages the abutment members, and on the rivet being pushed into the tool so that the pulling head is engaged by the collet assembly, the abutment members are moved axially and are caused to close firmly about the mandrel.

8 Claims, 2 Drawing Sheets

RIVET SETTING TOOL

BACKGROUND OF THE INVENTION

The present invention is concerned with riveting tools for use in setting blind rivets of the type which comprises a tubular rivet having a head, and a mandrel which passes through the tubular rivet and comprises a setting head which engages an end face of the tubular rivet remote from its head and a pulling head which is pulled to move the mandrel relative to the rivet to set it. Such rivets are commonly referred to as "double headed rivets".

A tool for setting a double headed rivet requires a nose piece supporting a pulling assembly, adapted to grip the pulling head of the mandrel to Dull the rivet to set the rivet, and an abutment assembly arranged to engage the head of the rivet during its setting. It is necessary that the abutment assembly is capable of moving into an open position to allow the passage of the pulling head of the mandrel past the abutment assembly to engage the pulling assembly and then into a closed position to provide an abutment to engage the head of the rivet.

In a known riveting tool for use with double headed rivets, the abutment assembly comprises a plurality of abutment members extending generally axially of the nosepiece around the pulling assembly and movable between an open position, in which the pulling head of the mandrel may be passed through the abutment assembly to be engaged by the pulling assembly and a closed position in which the abutment members provide an abutment to engage the rivet head. The abutment members are moved radially between their open and closed positions by a sleeve which is moved axially of the tool by a pneumatic piston and cylinder arrangement. This piston and cylinder arrangement is actuated by a sensor which detects when a rivet has been positioned in the pulling assembly and then causes the abutment members to close.

This construction is somewhat complex and expensive.

It is an object of the present invention to provide a riveting tool for use with double headed rivets which is simpler and more economical in construction.

BRIEF DESCRIPTION OF THE INVENTION

The present invention provides a riveting tool for use in setting blind rivets which comprise a tubular rivet having a head and a mandrel which passes through the tubular rivet and comprises a setting head, which engages an end face of the rivet, and a pulling head which is pulled to move the mandrel relative to the rivet to set it the tool comprising a nose piece a pulling assembly mounted in the nosepiece and arranged to grip the pulling head of a mandrel and movable relative to the nosepiece to pull the mandrel to set the rivet an abutment assembly mounted on the nosepiece and arranged to engage the head of the rivet during its setting and comprising a plurality of abutment members extending generally axially of the nosepiece around the pulling assembly and movable between an open position, in which the pulling head of the mandrel may be passed through the abutment assembly to be engaged by the pulling assembly, and a closed position in which the abutment members provide an abutment to engage the rivet head characterized in that the abutment members are mounted for generally axial movement relative to the nosepiece against spring pressure and comprise cam means which on such axial movement cause the abutment members to move from their open to their closed positions and the pulling assembly comprises a collet assembly comprising collet members having latches adapted to engage behind the head of a mandrel whereby, when a blind rivet is presented axially to the tool, the head of the rivet engages the abutment members and on the rivet being pushed into the tool so that the pulling head of the mandrel is engaged by the latches of the collet members, the abutment members are moved axially relative to the nosepiece to move from their open to their closed position, and close firmly about the mandrel.

BRIEF DESCRIPTION OF THE DRAWINGS

In the accompanying drawings

DETAILED DESCRIPTION OF EMBODIMENT AND DRAWINGS

Figure 2:
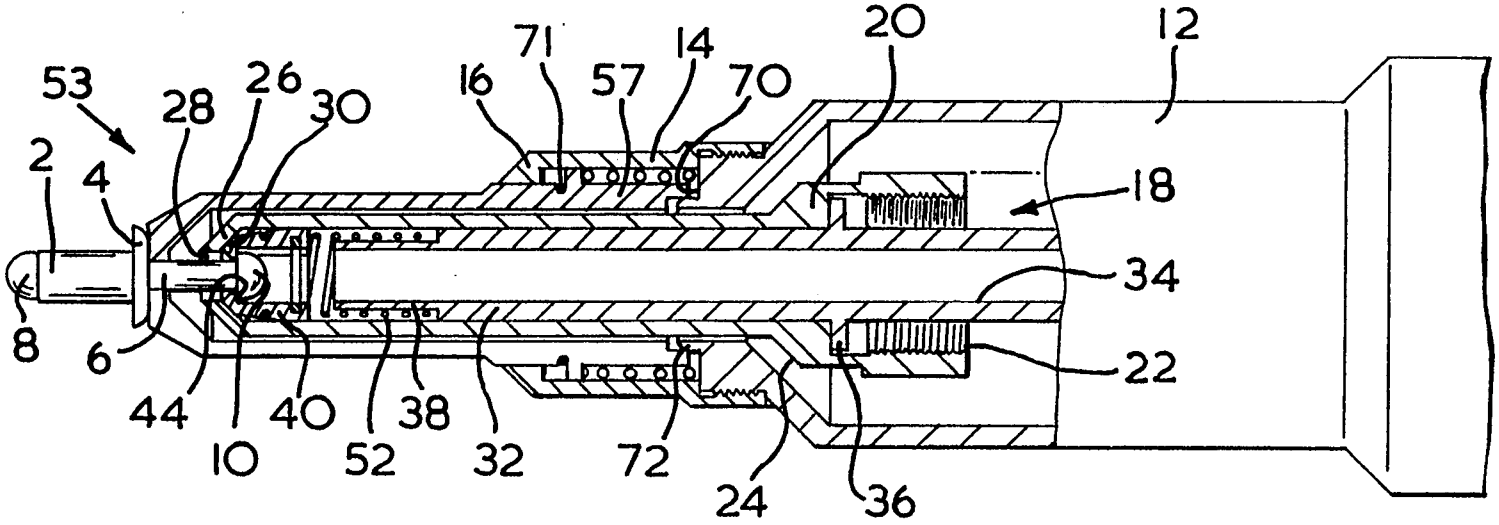
FIG. 2 shows the head shown in FIG. 1 with a blind rivet in position.

The tool according to the invention is a tool for setting blind rivets of the "double headed" type, that is to say blind rivets as shown in FIG. 2 which comprise a tubular rivet 2 having a head 4 and a mandrel 6 which passes through the rivet 2 and which has a setting head 8 which engages an end face of the tubular rivet 2 remote from the head 4, and a pulling head 10. It will be understood that the rivet 2 is set by pulling the head 10 while restraining the rivet 2 by engagement of the rivet head 4.

The tool comprises a nose piece 12 which is fixed to the body of the tool (not shown) and which comprises a cad 14 which comprises a forward lip portion 16 and is screwed onto a rearward portion of the nosepiece. Slidably mounted in the nosepiece 12 is a pulling assembly 18, arranged to grip the pulling head 10 of a mandrel 6. The assembly 18 comprises a setting member 20 which has a internally threaded end portion 22 by which it can be secured to pulling mechanism of the tool. Engagement of a conical surface 24 of the member 20 with an internal conical surface of the nose piece 12 limits forward movement of the member 20. The member 20 comprises a generally conical forward end portion 26 having a central aperture 28 large enough to accept the setting head 10 of a rivet. The end portion 26 has an internal conical surface 30.

Mounted in the member 20, for limited relative movement with it, is a tubular member 32 having an internal bore 34 through which broken mandrels resulting from the setting of rivets can be extracted. The tubular member 32 has a flange 36 which abuts against an internal surface of the setting member 20, and a reduced end portion 38.

Figure 3:
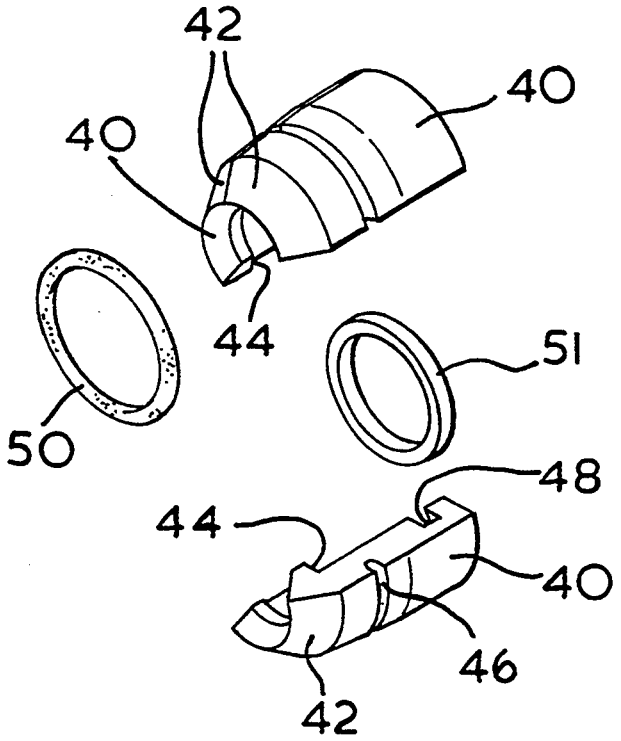
FIG. 3 shows a detail of a pulling collet of the head, partly disassembled.

A collet assembly is provided which comprises three identical collet members 40 which are each in the shape of 120° segments (see FIG. 3) [it will be understood that, dependent on the size of the rivet, it may be appropriate to have a different number of collet members, provided there are at least two]. Each collet member comprises a forward conical surface 42, an internal pulling latch 44, an external groove 46 and an internal groove 48. The latches 44 are adapted to engage behind the head 10 of the mandrel 6. The collet members are assembled into a unit which may be positioned in the pulling assembly, with resilient means in the form of an O ring 50 positioned in the grooves 46 holding the collet members together, and a spacer in the form of a rigid washer 51 in the grooves 48 holding the members 40 in correct spaced relationship. The collet assembly is positioned in the setting member 20 forward of the tubular member 32 and a coil spring 52 which surrounds the reduced end portion 38 of the tubular member 32 urges the collet assembly forwards so that the conical surfaces 42 of the collet members 40 are urged against the internal conical surface 30 of the end portion 26 of the member 20.

The tool also comprises an abutment assembly 53 mounted on the nosepiece 12 which is arranged to engage the head 4 of the rivet during its setting. The assembly 53 comprises three rivet setting abutment members 54, each of identical construction and extending generally axially of the nosepiece 12 around the pulling assembly 18. Each member 54 is in cross-section a 120° segment, and comprises a body portion 56 and an enlarged rearward portion 57. The body portion 56 supports an inwardly extending forward abutment portion 58. The rearward portion 57 of the member 54 comprises a cam member in the form of a rearwardly extending arcuate lug 60, and an outwardly extending lug in the form of a ring portion 62 adjacent to which is an external groove 64.

Figure 1:
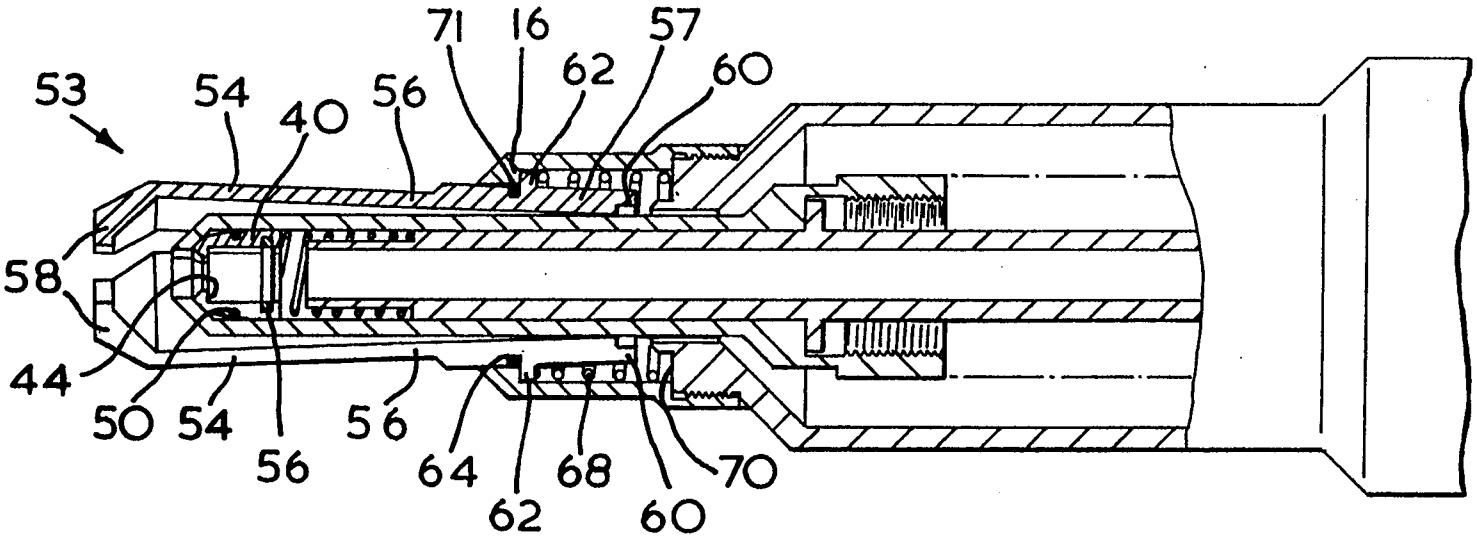
FIG. 1 shows a head of a blind riveting tool in a rest position.

Each member 54 is mounted for generally axial sliding movement relative to the nosepiece 12, the rearward portion 54 being mounted between the cap 14 and the tubular member 32 of the pulling assembly. In the rest position of the head shown in FIG. 1 a spring 68, which acts between the ring portion 62 of each member 54 and a forward face 70 of the nosepiece 12 urges the ring portions 62 of the members 54 against the lip portion 16 of the cap 14. The three members 54 are lightly held together by an O ring 71 in the grooves 64. The effect of the pressure exerted by the spring 68, the constraint of the O ring 71 and engagement of the ring portion 62 with the lip 16 is to cause the members 54 to tilt, effectively about their rearward end portions, to move the three abutment portions 58 radially apart. The abutment members 54 are thus movable between an open position (FIG. 1) in which the pulling head 10 of the mandrel 6 may be passed through the abutment assembly 53 to be engaged by the pulling assembly 18, and a closed position (FIG. 2) in which the abutment members provide an abutment to engage the rivet head.

When a blind rivet is presented axially to the tool, the pulling head 10 passes through the aperture 28 and, forcing the collet members 40 apart, partly against the pressure of the spring 52 and partly against the O ring 50, moves into a position as shown in FIG. 2 where the latches 44 of the collet members 40 engage under the pulling head 10. At the same time, engagement of the head 4 of the rivet with the abutment portions 58 pushes the abutment members 54 rearwardly relative to the cap 14 against the spring 68. The rearward lugs 60 are caused to slide over a forwardly extending camming ring 72 of the nosepiece 12, thus causing the member 54 to assume axially parallel positions as shown in FIG. 2, moving from their open to their closed position with the rivet head 4 firmly seated against the member 54 which close firmly about the mandrel 6.

In this condition the tool can be readily manipulated to position the rivet in the hole in which it is to be set, the rivet being firmly held in the tool. By Operation of the tool to cause relative movement between the nosepiece 12 and the pulling assembly 18, the rivet can be set.

It will be understood that the construction of this tool is comparatively simple and inexpensive. It also has the characteristic that a double headed rivet may be very easily inserted into the nosepiece, and once inserted is firmly held in position without any further action by the operator being necessary, and locks the abutment members of the tool in closed position, thus enabling convenient presentation of the rivet to a workpiece.

We claim:

1. A riveting tool for use in setting blind rivets which comprise a tubular rivet having a head and a mandrel which passes through the tubular rivet and comprises a setting head, which engages an end face of the rivet, and a pulling head which is pulled to move the mandrel relative to the rivet to set it, the tool comprising a nose piece, a pulling assembly mounted in the nosepiece and arranged to grip the pulling head of a mandrel and movable relative to the nosepiece to pull the mandrel to set the rivet, an abutment assembly mounted on the nosepiece and arranged to engage the head of the rivet during its setting and comprising a plurality of abutment members extending generally axially of the nosepiece around the pulling assembly and movable between an open position, in which the pulling head of the mandrel may be passed through the abutment assembly to be engaged by the pulling assembly, and a closed position in which the abutment members provide an abutment to engage the rivet head, wherein the abutment members are mounted for generally axial movement relative to the nosepiece against spring pressure and comprise cam means which on such axial movement cause the abutment members to move from their open to their closed positions and the pulling assembly comprising a collet assembly comprising collet members having latches adapted to engage behind the head of a mandrel, whereby, when a blind rivet is presented axially to the tool, the head of the rivet engages the abutment members, and on the rivet being pushed into the tool so that the pulling head of the mandrel is engaged by the latches of the collet members, the abutment members are moved axially relative to the nosepiece to move from their open to their close positions, and close firmly about the mandrel.

2. A riveting tool according to claim 1 in which the collet members are assembled into a unit, resilient means holding the collet members together and a spacer holding the members in correct spaced relationship.

3. A riveting tool according to claim 2 wherein the spacer is a washer which is engaged in grooves an the collet members.

4. A riveting tool according to claim 2 in which the unit comprises three identical collet members.

5. A riveting tool according to claim 1, wherein the nosepiece comprises a cap which surrounds the pulling assembly, and each abutment member comprises a rearward portion which is mounted for axial sliding movement between the pulling assembly and the cap.

6. A riveting tool according to claim 1, wherein a spring acting between the abutment members and the nosepiece, urges the abutment members forwardly.

7. A riveting tool according to claim 6, wherein each abutment member comprises a cam member on its rearward portion which, when the abutment member is moved rearwardly against the spring, engages a camming member of the nosepiece to cause the abutment member to pivot from its open to its closed position.

8. A riveting tool according to any claim 1, wherein the abutment assembly comprises three identical abutment members.

* * * * *